US009937507B2

(12) United States Patent
Dau et al.

(10) Patent No.: US 9,937,507 B2
(45) Date of Patent: Apr. 10, 2018

(54) ELECTROSTATIC SPRAYING APPARATUS, AND CURRENT CONTROL METHOD FOR ELECTROSTATIC SPRAYING APPARATUS

(71) Applicant: SUMITOMO CHEMICAL COMPANY, LIMITED, Tokyo (JP)

(72) Inventors: Van Thanh Dau, Takarazuka (JP); Tibor Terebessy, Wallingford (GB)

(73) Assignee: SUMITOMO CHEMICAL COMPANY, LIMITED, Tokyo (JP)

( * ) Notice: Subject to any disclaimer, the term of this patent is extended or adjusted under 35 U.S.C. 154(b) by 349 days.

(21) Appl. No.: 14/771,236

(22) PCT Filed: Feb. 9, 2014

(86) PCT No.: PCT/JP2014/053880

§ 371 (c)(1),
(2) Date: Aug. 28, 2015

(87) PCT Pub. No.: WO2014/132854

PCT Pub. Date: Sep. 4, 2014

(65) Prior Publication Data

US 2016/0008829 A1 Jan. 14, 2016

(30) Foreign Application Priority Data

Mar. 1, 2013 (JP) ..... 2013-041226

(51) Int. Cl.

| | |
|---|---|
| ***B05B 5/053*** | (2006.01) |
| ***B05B 5/025*** | (2006.01) |
| *B05B 5/057* | (2006.01) |

(52) U.S. Cl.

CPC ..... *B05B 5/0533* (2013.01); *B05B 5/0255* (2013.01); *B05B 5/057* (2013.01)

(58) Field of Classification Search

CPC ..... B05B 5/025; B05B 5/0255; B05B 5/035; B05B 5/0533; B05B 12/08; B05B 12/12; B05B 5/057

See application file for complete search history.

(56) References Cited

U.S. PATENT DOCUMENTS 2,890,388 A 6/1959 Croskey et al.
4,476,515 A * 10/1984 Coffee ..... B05B 5/04 118/626

(Continued)

FOREIGN PATENT DOCUMENTS

EP 2 025 411 A1 2/2009
JP 2004-530552 A 10/2004

(Continued)

OTHER PUBLICATIONS

International Preliminary Report on Patentability issued in corresponding application No. PCT/JP2014/053880 dated Sep. 11, 2015.

(Continued)

*Primary Examiner* — Christopher Kim
(74) *Attorney, Agent, or Firm* — Foley & Lardner LLP

(57) ABSTRACT

An electrostatic atomizer (100) includes a spray electrode (1), a reference electrode (2), a control circuit (24) for controlling a value of a current at the reference electrode (2), and a high-voltage generator (22) for applying a voltage between the spray electrode (1) and the reference electrode (2). The control circuit (24) controls the value of the current at the reference electrode (2) so that the value of this current can be higher than a spray current corresponding to a prescribed spray amount of a substance.

3 Claims, 8 Drawing Sheets

(56) References Cited

U.S. PATENT DOCUMENTS

| | | | |
|---|---|---|---|
| 2004/0251326 | A1 | 12/2004 | Pirrie |
| 2010/0243767 | A1 | 9/2010 | Mori et al. |
| 2011/0073686 | A1 | 3/2011 | Uegaki et al. |
| 2014/0151471 | A1 | 6/2014 | Dau et al. |
| 2015/0021420 | A1 | 1/2015 | Dau et al. |

FOREIGN PATENT DOCUMENTS

| | | | |
|---|---|---|---|
| JP | 2005-028323 | A | 2/2005 |
| JP | 2006-239632 | A | 9/2006 |
| JP | 2010-104989 | A | 5/2010 |
| JP | 2011-073617 | A | 4/2011 |
| JP | 2012-011298 | A | 1/2012 |
| JP | 2013-027832 | A | 2/2013 |
| TW | 200808452 | A | 2/2008 |
| WO | WO-2007/144649 | A2 | 12/2007 |

OTHER PUBLICATIONS

International Search Report issued in corresponding application No. PCT/JP2014/053880 dated May 20, 2014 (with English translation).
Office Action dated Feb. 28, 2017 in the corresponding Chinese Patent Application No. 201480010162.1 with English translation.
Extended European Search Report issued in EP Patent Application No. 14756407.4 dated Oct. 6, 2016.
First Office Action issued in Australian Patent Application No. 2014221964 dated Aug. 4, 2017.
Notification of Reasons for Refusal issued in Japanese Patent Application No. 2013-041226 dated Jun. 21, 2016.
Office Action issued in Chinese Patent Application No. 201480010162.1 dated Sep. 19, 2017.
Notification of Reasons for Refusal issued in Japanese Patent Application No. 2013-041226 dated Nov. 8, 2016.
Office Action issued in Chinese Patent Application No. 201480010162.1 dated Aug. 3, 2016.

* cited by examiner

ELECTROSTATIC SPRAYING APPARATUS, AND CURRENT CONTROL METHOD FOR ELECTROSTATIC SPRAYING APPARATUS

TECHNICAL FIELD

The present invention relates to an electrostatic atomizer and a current control method for the electrostatic atomizer.

BACKGROUND ART

Conventionally, an atomizer which sprays a liquid in a container via a nozzle has been widely used in various fields. A known example of such an atomizer is an electrostatic atomizer which atomizes and sprays a liquid by Electro Hydrodynamics (EHD). The electrostatic atomizer forms an electric field near a tip of a nozzle and uses the electric field to atomize and spray the liquid at the tip of the nozzle. Patent Literature 1 is known as a document which discloses such an electrostatic atomizer.

CITATION LIST

Patent Literature

Patent Literature 1

Japanese Translation of PCT International Publication, Tokuhyo, No. 2004-530552 (Publication Date: Oct. 7, 2004)

SUMMARY OF INVENTION

Technical Problem

However, in a technique disclosed in Patent Literature 1, there is still a room for improvement in the following points.

The electrostatic atomizer of Patent Literature 1 includes a spray electrode and a reference electrode. The spray electrode is a conduit which is used for spraying a liquid. When a voltage is applied between the spray electrode and the reference electrode, an electric field is formed between the spray electrode and the reference electrode.

In the electrostatic atomizer, in a case where a droplet attaches to a device surface, the droplet causes an electric connection between the spray electrode and the reference electrode. This may lead to the occurrence of a leak current between the spray electrode and the reference electrode. In a case where the leak current occurs, an amount of liquid sprayed from the electrostatic atomizer may become unstable.

As a possible example case where a droplet attaches to the electrostatic atomizer between the spray electrode and the reference electrode, there is a case where a sprayed substance attaches to the electrostatic atomizer in a case where the sprayed substance is sprayed back in a direction toward the reference electrode, that is, a direction toward the electrostatic atomizer (hereinafter, this phenomenon is also referred to as "spray-back"). Alternatively, a droplet may attach to the electrostatic atomizer between the spray electrode and the reference electrode in a case where an environment surrounding the electrostatic atomizer is under a high-humidity condition. In electrostatic atomizers, it is an important matter to maintain stable spray by controlling unstable spray due to a leak current even in a case where the leak current occurs between the spray electrode and the reference electrode.

The present invention is attained in view of the above problems. An object of the present invention is to provide an electrostatic atomizer excellent in spray stability, and a current control method for the electrostatic atomizer.

Solution to Problem

In order to solve the above problems, an electrostatic atomizer according to one aspect of the present invention includes: a first electrode which sprays a substance from a tip; a second electrode being one of two electrodes between which a voltage is applied, the first electrode being another one of the two electrodes; a current control section for controlling a value of a current at the second electrode; and a voltage applying section for applying the voltage between the first electrode and the second electrode, in accordance with the value of the current controlled by the current control section, the current control section controlling the value of the current at the second electrode so that the value of the current is set to a second current value which is higher than a first current value corresponding to a prescribed spray amount of the substance.

In order to solve the above problems, a current control method according to one aspect of the present invention for an electrostatic atomizer including a first electrode which sprays a substance from a tip; and a second electrode being one of two electrodes between which a voltage is applied, the first electrode being another one of the two electrodes, the method includes the steps of: controlling a value of a current at the second electrode; and applying the voltage between the first electrode and the second electrode in accordance with the value of the current controlled in the step of controlling the value of the current, the step of controlling the value of the current controlling the value of the current at the second electrode so that the value of the current is set to a second current value which is higher than a first current value corresponding to a prescribed spray amount of the substance.

The electrostatic atomizer according to one aspect of the present invention positively charges (or negatively charges) the first electrode while negatively charging (or positively charging) the second electrode, thereby spraying a substance from the first electrode.

In the electrostatic atomizer, the value of the current measured at the second electrode indicates a value of a current at the first electrode, based on the principle of charge equilibration. This value of the current at the first electrode is the sum of a current (hereinafter, also referred to as a corona current) which ionizes the air and a current (hereinafter, also referred to as a spray current) for charging the substance and causing a prescribed amount of the substance to be sprayed. In addition, under a high-humidity condition, a leak current may exist between the first electrode and the second electrode. In a case where the leak current exists, the value of the current at the second electrode is the sum of the spray current, the corona current, and the leak current.

The inventors of the present application found that in the electrostatic atomizer, a spray amount of the substance does not change largely even in a case where a voltage is applied between the first electrode and the second electrode in accordance with the second current value larger than the first current value.

This is because even in a case where the second electrode is controlled so as to have the second current value larger than the first current value, a difference between the second current value and the first current value is used in corona discharge and thereby, the influence of the current at the second electrode on the spray current is suppressed. Accordingly, even in a case where the second electrode is controlled so as to have the second current value, the spray current does not change largely. Therefore, the electrostatic atomizer according to one aspect of the present invention can maintain stable spray.

Further, the inventors of the present application also found that in a case where a leak current occurs between the first electrode and the second electrode at the time when the second electrode is controlled so as to have the second current value, a current corresponding to a difference (or part of a difference) between the first electrode and the second electrode is used as the leak current. In other words, even in a case where the leak current occurs, the influence of the leak current on the spray current can be suppressed and stable spray can be maintained.

Therefore, the electrostatic atomizer according to one aspect of the present invention and the current control method for the electrostatic atomizer are configured as described above and accordingly make it possible to provide an electrostatic atomizer excellent in spray stability.

Advantageous Effects of Invention

An electrostatic atomizer of the present invention is configured to include: a first electrode which sprays a substance from a tip; a second electrode being one of two electrodes between which a voltage is applied, the first electrode being another one of the two electrodes; a current control section for controlling a value of a current at the second electrode; and a voltage applying section for applying the voltage between the first electrode and the second electrode, in accordance with the value of the current controlled by the current control section, the current control section controlling the value of the current at the second electrode so that the value of the current is set to a second current value which is higher than a first current value corresponding to a prescribed spray amount of the substance.

Further, a current control method of the present invention for an electrostatic atomizer including a first electrode which sprays a substance from a tip; and a second electrode being one of two electrodes between which a voltage is applied, the first electrode being another one of the two electrodes, the method includes the steps of: controlling a value of a current at the second electrode; and applying the voltage between the first electrode and the second electrode in accordance with the value of the current controlled in the step of controlling the value of the current, the step of controlling the value of the current controlling the value of the current at the second electrode so that the value of the current is set to a second current value which is higher than a first current value corresponding to a prescribed spray amount of the substance.

Therefore, the electrostatic atomizer according to the present invention and a current control method for the electrostatic atomizer make it possible to advantageously provide an electrostatic atomizer excellent in spray stability.

DESCRIPTION OF EMBODIMENTS

The following discusses an electrostatic atomizer 100 of the present embodiment with reference to drawings. In the following description, identical members and components are given identical reference signs, respectively, and have identical names and identical functions. Thus, detailed descriptions of the members and components are not repeated.

[Configuration of Main Part of Electrostatic Atomizer 100]

Figure 2:
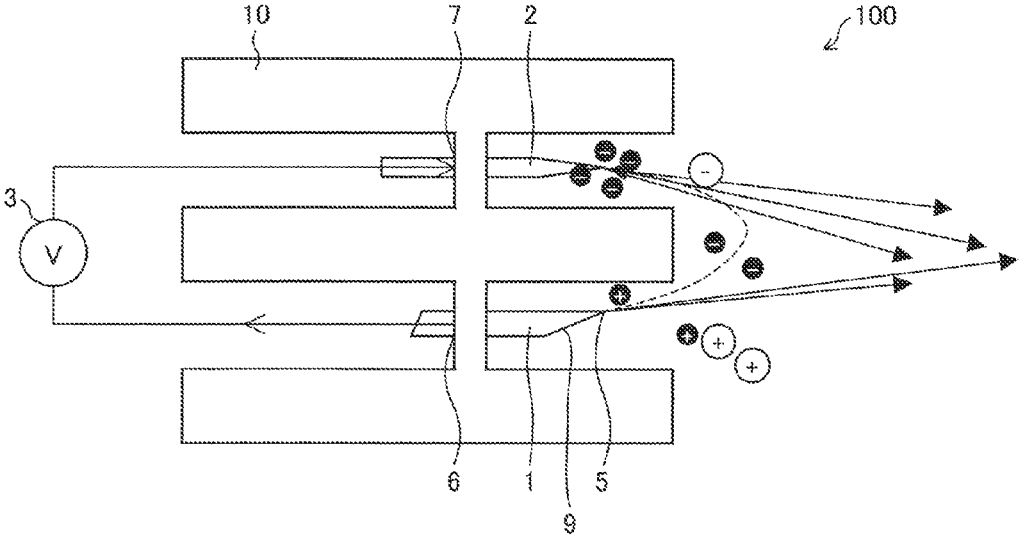
FIG. 2 is a view illustrating a configuration of a main part of an electrostatic atomizer according to an embodiment of the present invention.

First, the following discusses a configuration of a main part of an electrostatic atomizer 100 with reference to FIG. 2.

The electrostatic atomizer 100 is used for, for example, spraying aromatic oil, a chemical substance for an agricultural product, a medicine, an agricultural chemical, a pesticide, an air cleaning agent, and the like. The electrostatic atomizer 100 includes at least a spray electrode 1 (a first electrode), a reference electrode 2 (a second electrode), a power supply device 3, and a dielectric 10. Alternatively, the electrostatic atomizer 100 of the present embodiment may be realized by a configuration according to which the power supply device 3 is provided outside the electrostatic atomizer 100 and the electrostatic atomizer 100 is connected with the power supply device 3.

The spray electrode 1 includes a conductive conduit such as a metallic capillary (e.g., type 304 stainless steel), and a tip 5. The spray electrode 1 ejects a substance to be atomized from the tip 5. The spray electrode 1 is electrically connected with the reference electrode 2 via the power supply device 3. The spray electrode 1 has an inclined plane 9, which inclines with respect to an axial center of the spray electrode 1 and has a shape that becomes thinner and sharper toward the tip of the spray electrode 1. Such a tip shape of the spray electrode 1 defines a spray direction in which an atomized substance is to be sprayed.

The reference electrode 2 includes a conductive rod such as a metal pin (e.g., type 304 steel pin). The spray electrode 1 and the reference electrode 2 are provided parallel with each other so as to be spaced apart from each other with a prescribed distance therebetween. The spray electrode 1 and the reference electrode 2 are provided so as to be spaced apart from each other by a distance of, for example, 8 mm.

The power supply device 3 is provided for applying a voltage between the spray electrode 1 and the reference electrode 2. For example, the power supply device 3 applies a high voltage of 1 kV to 30 kV (e.g., 3 kV to 7 kV) between the spray electrode 1 and the reference electrode 2. When a high voltage is applied between the spray electrode 1 and the reference electrode 2, an electric field is formed between the spray electrode 1 and the reference electrode 2. This causes an electric dipole inside the dielectric 10. At this point in time, the spray electrode 1 is positively charged, and the reference electrode 2 is negatively charged (alternatively, the spray electrode 1 may be negatively charged, and the reference electrode 2 may be positively charged). Then, a negative dipole occurs on a surface of the dielectric 10 which surface is the closest to the spray electrode 1 that is positively-charged, and a positive dipole occurs on a surface of the dielectric 10 which surface is the closest to the reference electrode 2 that is negatively-charged, so that a charged gas and a charged substance species are released by the spray electrode 1 and the reference electrode 2. As described above, an electric charge generated by the reference electrode 2 at this point in time has a polarity opposite to that of a substance to be sprayed. Therefore, the electric charge of the substance to be sprayed is balanced by an electric charge generated by the reference electrode 2. This allows the electrostatic atomizer 100 to perform stable spray by current feedback control, based on the principle of charge equilibration. This will be described in detail later.

The dielectric 10 is made of a dielectric material such as nylon 6, nylon 11, nylon 12, nylon 66, polypropylene, or a polyacetyl-polytetrafluoroethylene mixture. The dielectric 10 supports the spray electrode 1 at a spray electrode mounting section 6 and also supports the reference electrode 2 at a reference electrode mounting section 7.

Figure 3:
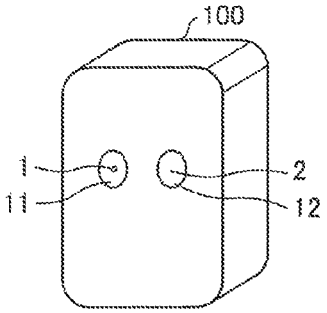
FIG. 3 is a view illustrating an appearance of an electric atomizer according to an embodiment of the present invention.

Next, the following discusses an appearance of the electrostatic atomizer 100 with reference to FIG. 3. FIG. 3 is a view illustrating an appearance of the electrostatic atomizer 100.

As illustrated in FIG. 3, the electrostatic atomizer 100 has a rectangular shape (or may have another shape). The spray electrode 1 and the reference electrode 2 are provided on one surface of the electrostatic atomizer 100. As illustrated in FIG. 3, the spray electrode 1 is provided in the vicinity of the reference electrode 2. Further, a circular opening 11 and a circular opening 12 are provided so as to surround the spray electrode 1 and the reference electrode 2, respectively. A voltage is applied between the spray electrode 1 and the reference electrode 2, so that an electric field is formed between the spray electrode 1 and the reference electrode 2. The spray electrode 1 sprays a positively charged droplet. The reference electrode 2 ionizes and negatively charges air in the vicinity of the reference electrode 2. Then, the negatively charged air moves away from the reference electrode 2, due to the electric field formed between the spray electrode 1 and the reference electrode 2 and a repulsive force among particles of the negatively charged air. This movement creates an air flow (hereinafter, the air flow may also be referred to as an ion stream), and the positively charged droplet is sprayed in a direction away from the electrostatic atomizer 100 due to the ion stream.

Note that the openings 11 and 12 are not specifically limited in shape, size, position, etc. but can be changed as appropriate.

[2. Power Supply Device 3]

Figure 1:
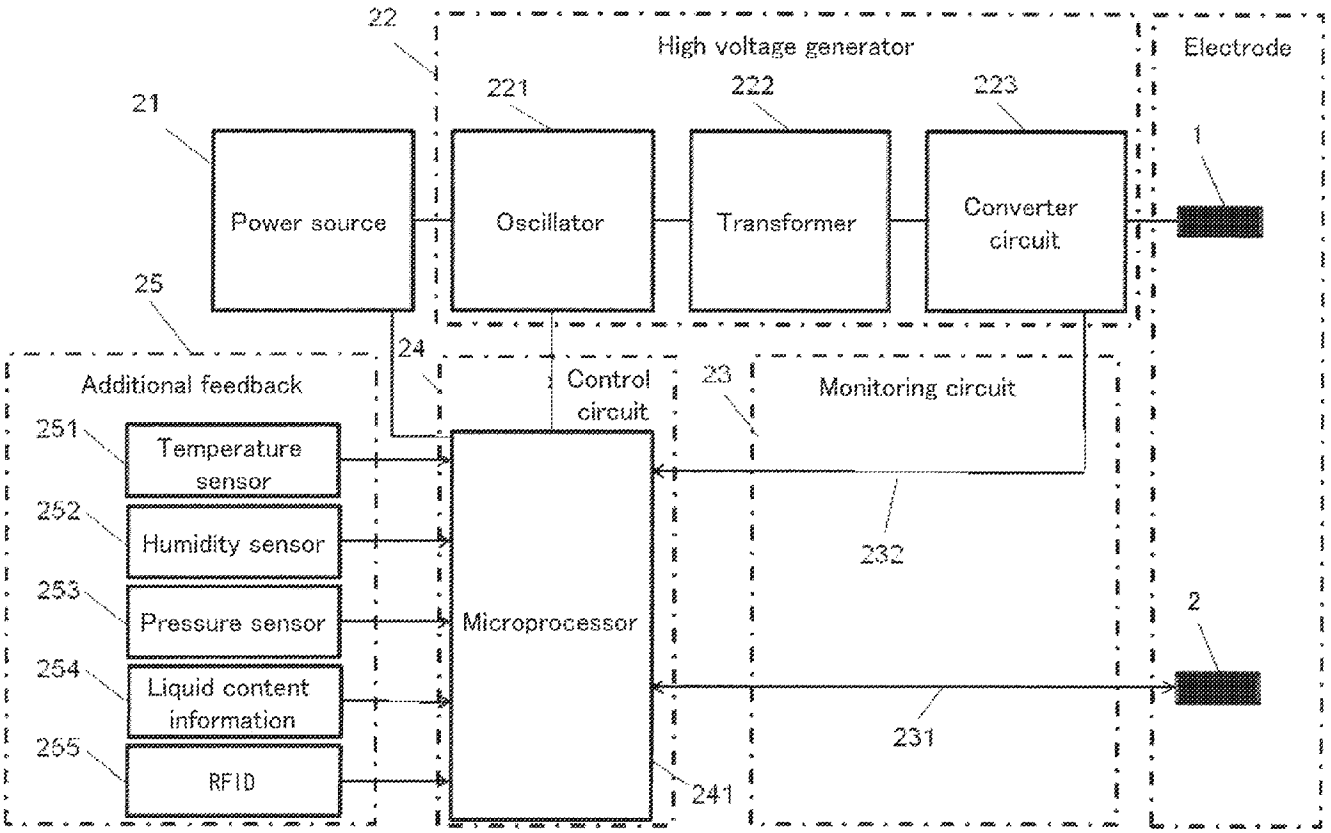
FIG. 1 is a view illustrating an example configuration of a power supply device according to an embodiment of the present invention.

FIG. 1 is a view illustrating an example configuration of the power supply device 3. The power supply device 3 includes a power source 21, a high voltage generator (voltage applying section) 22, a monitoring circuit 23 adapted to monitor output voltages corresponding to currents at the spray electrode 1 and the reference electrode 2, and a control circuit (current control section) 24 adapted to control the high voltage generator 22 so that an output voltage of the high voltage generator 22 may have a desired value (voltage control step, the step of controlling a voltage) in a state in which a current value at the reference electrode 2 is controlled to be a prescribed value (within a prescribed range) (current control step, the step of controlling a current). For various practical applications, the control circuit 24 may include a microprocessor 241. The microprocessor 241 may be designed to allow further adjustment of an output voltage and a spray time based on other feedback information 25. The feedback information 25 includes environmental conditions (temperature, humidity, and/or atmospheric pressure), a liquid amount, an optional user setting, and the like.

The power source 21 can be a well-known power source and includes a main power source or at least one battery. The power source 21 is preferably a low voltage supply, or a direct current (DC) power supply. For example, one or more voltaic cells may be combined to form a battery. A suitable battery includes one or more AA- or D-cell batteries. The number of batteries is determined by a required voltage level and a power consumption of the power source.

The high voltage generator 22 includes an oscillator 221 which converts DC to AC, a transformer 222 that is driven by AC, and a converter circuit 223 connected to the transformer 222. The converter circuit 223 typically includes a charge pump and a rectifier circuit. The converter circuit 223 generates a desired voltage and converts AC back into DC. A typical converter circuit is a Cockcroft-Walton generator.

The monitoring circuit 23 includes a current feedback circuit 231, and may also include a voltage feedback circuit 232 depending on an application. The current feedback circuit 231 measures an electric current at the reference electrode 2. Because the electrostatic atomizer 100 is charge balanced, measurement of the current at the reference electrode 2 and reference to thus measured current provide an accurate monitor of the current at the tip 5 of the spray electrode 1. Such a method eliminates the necessity of provision of an expensive, complex or disruptive measuring section to the tip 5 of the spray electrode 1. The current feedback circuit 231 may include any conventional current measurement device, for example, a current transformer.

In a preferred embodiment, the current at the reference electrode 2 is measured by measuring a voltage across a set resistor (feedback resistor) which is series-connected with the reference electrode 2. In an embodiment, the voltage measured across the set resistor is read by using an analogue to digital (A/D) converter, which is typically part of the microprocessor. A suitable microprocessor with an A/D converter encompasses a microprocessor of the PIC16F18 family produced by Microchip. The digital information is processed by the microprocessor to provide an output for the control circuit 24**.

In a preferred embodiment, the voltage measured across the set resistor is compared with a prescribed constant reference voltage level by using a comparator. Comparators require only very low current input (typically nanoampere or lower) and make a fast response. The microprocessor 241 often provides built-in comparators for such a purpose. For example, PIC16F1824 of the above mentioned microchip family provides a suitable comparator with very low current input and constant reference voltage. The reference voltage level to be inputted to the comparator is set by use of a D/A converter that is also included in the microprocessor 241. Here, selectable reference voltage levels are provided in advance. In typical operation, this circuit is able to detect whether the measured current is below or above a requested level that is determined by the magnitude of reference voltage and the feedback resistor, and to supply the information to the control circuit 24.

In applications where the knowledge of a precise voltage value is required, the monitoring circuit 23 also includes the voltage feedback circuit 232, measuring the applied voltage to the spray electrode 1. Typically, the applied voltage is directly monitored by measuring the voltage at a junction of two resistors forming a potential divider connected between two electrodes. Alternatively, the applied voltage may be monitored by measuring a voltage developed at a node within the Cockcroft-Walton generator, by using the same potential divider principle. Similarly, as for current feedback, the feedback information may be processed either via an A/D converter or by comparing a feedback signal with a reference voltage level by using a comparator.

The control circuit 24 controls the output voltage of the high voltage generator 22 by controlling an amplitude, a frequency, or a duty cycle of oscillation in the oscillator 211, or an on/off time of a voltage (or combinations of these). In this example, the control circuit 24 controls the output voltage of the high voltage generator 22 by directing the oscillator 221 to produce bursts of alternating current at a prescribed frequency whereby the duration and/or duty cycle of the bursts of alternating current determines the output voltage. The control circuit 24 receives a signal indicating a monitored current at the tip 5 as an output from a comparator and adjusts the duration and/or the duty cycle of the bursts of AC to vary the value of the output of the high voltage generator to a desired value in accordance with a prescribed characteristic.

The control circuit 24 may be adapted to use a pulse width modulation (PWM) scheme (use a pulse-width modulated signal) in order to provide an adjustable limit for the output voltage of the high voltage generator by setting a limit value for the PWM duty cycle. Typically, the control circuit 24 is an output port of the microprocessor 241, capable of providing a PWM signal. The spray duty cycle and spray period may also be controlled via the same PWM output port. During spraying, the PWM signal is applied. The voltage can be adjusted either by changing the duty cycle of the PWM signal or by turning the PWM signal rapidly ON and OFF based on the feedback information. The firmware implementation of the control circuit 24 depends on the required compensation scheme. For example, a simple feedback control, where the output voltage needs to be adjusted in order to keep the spray current (first current value) constant, can be realized just by configuring auto-shutdown and auto-restart of the PWM signal based on the comparator output of the current feedback. This type of configuration is provided in the above-mentioned PIC16F1824 microcontroller.

[Current Feedback Control]

As described above, the power supply device 3 compensates the output voltage of the high voltage generator 22 so that the current value at the reference electrode 2 can be controlled to be a prescribed value (within a prescribed range). This compensation scheme makes it possible to compensate a change in resistance value of the reference electrode 2, in a case where a droplet attaches to the surface of the electrostatic atomizer 100 and this causes the change in resistance value of the reference electrode 2. Based on the principle of charge equilibration, the current value measured at the reference electrode 2 indicates a value of a current generated at the spray electrode 1. This value of the current generated at the spray electrode 1 is the sum of a corona current which ionizes the air and a current (hereinafter, also referred to as a spray current) for generating a positively-charged droplet and causing a prescribed amount of a substance to be sprayed. In addition, under a high-humidity condition, a leak current exists on the surface of the dielectric 10 between the spray electrode 1 and the reference electrode 2. In a case where the leak current exists, the current value measured at the reference electrode 2 is the sum of the spray current, the corona current, and the leak current.

The leak current here can be reduced by increasing a distance between the spray electrode 1 and the reference electrode 2. However, it is often difficult to change the distance between the spray electrode 1 and the reference electrode 2 due to a design, a layout, and/or the like of the electrostatic atomizer.

On this account, in the electrostatic atomizer 100, the current feedback control explained below is used to prevent unstable spray and thereby achieve stable spray.

Note that the current value of the spray current can be adjusted as a factory default of the power supply device 3.

[1. Current Feedback Control with Use of Sensor]

The following discusses current feedback control with use of a sensor with reference to FIG. 1.

In the power supply device 3, the feedback information 25 is inputted to the microprocessor 241. The feedback information 25 encompasses information from a temperature sensor (temperature detecting section) 251, a humidity sensor (humidity detecting section) 252, a pressure sensor 253, and RFID 255, liquid content information 254, and the like information. The information is provided in the form of analog information or digital information, and processed by the microprocessor 241. The microprocessor 241 provides compensation for improving spray quality and spray stability, by altering the spray period, an on time of spray or the applied voltage in accordance with the inputted information.

FIG. 1 shows as examples of the feedback information 25, information from the temperature sensor 251, the humidity sensor 252, the pressure sensor 253, and the RFID 255, and the liquid content information 254. Among the above information, a temperature is measured by the temperature sensor 251 such as a thermistor, while a relative humidity is measured by the humidity sensor 252. A result of such measurement is inputted, as the feedback information 25, to the microprocessor 241 and processed by the microprocessor 241.

As described above, in a case where a droplet attaches to the surface of the dielectric 10 due to moisture, that is, water in the air, a leak current may occur between the spray electrode 1 and the reference electrode 2. Here, the humidity sensor 252 is intended to measure a relative humidity but not to measure an amount of water in the air. Accordingly, the amount of water in the air is measured based on information on the temperature measured by the temperature sensor 251 and information (relative humidity information) on a humidity measured by the humidity sensor 252. The amount of water in the air can affect whether or not a leak current occurs between the spray electrode 1 and the reference electrode 2.

Note that the electrostatic atomizer 100 is not required to include the temperature sensor 251 and the humidity sensor 252 but can be realized by a configuration in which the electrostatic atomizer 100 is communicably connected with an external device and obtains information indicative of the amount of water in the air from the external device.

The microprocessor 241 adjusts the output voltage in accordance with a feedback current ($I_{feedback}$) (second current value) so that the current value at the second electrode 2 can be controlled to be a prescribed value.

The feedback current is initially set to a current value $I_{initial}$. In an example case, the current value $I_{initial}$ is set to 0.87 μA. Note here that it is assumed that no leak current has occurred before the current value $I_{initial}$ is set.

Then, in a case where the amount of water in the air is more than an amount of water under conditions of a temperature of 25 degrees and a relative humidity of 55%, the feedback current is adjusted based on a correction table which has been prepared in advance. The correction table here is a table in which an amount of water in the air is associated with a current value (I(T, RH)) which allows stable spray at the amount of water. When I(T, RH) is determined, the feedback current ($I_{feedback}$) is calculated by the following formula (1):

$$I_{feedback}=I_{initial}+I_W \quad \text{Formula (1)}$$

where $I_W$ is a correction current value set for each amount of water in the air.

Further, the amount of water in the air is obtained from the temperature and the relative humidity, the formula (1) can also be expressed as the formula (2).

$$I_{feedback}=I_{initial}+I(T,RH) \quad \text{Formula (2)}$$

where: T represents a temperature; RH represents a relative humidity; and I(T, RH) is a correction current value at the temperature T and the relative humidity RH.

The correction current value I(T, RH) is determined depending on the temperature and the relative humidity and corresponds to a value of a leak current actually measured under various environmental conditions. However, the correction current value I(T, RH) is not required to be the leak current value itself but can be determined to be a value larger than the leak current value. Further, I(T, RH) varies depending on each of electrostatic atomizers different in configuration, layout and/or the like. Accordingly, it is possible to mount a sprayhead-type interrogator circuit 255 such as RFID (Radio Frequency Identification) on the power supply device 3, so that the feedback current can be adjusted for each electrostatic atomizer.

Note that the above "conditions of a temperature of 25 degrees and a relative humidity of 55%" is merely one example, and the feedback current can certainly be adjusted with reference to an amount of water in the air under conditions of another temperature and another relative humidity. Further, the current value $I_{initial}$ can be set in advance as a factory default of the electrostatic atomizer 100.

Here, the temperature and the relative humidity each do not change drastically. Therefore, it is sufficient if the temperature and the relative humidity are measured prior to each spray cycle. In such a case, the feedback current is determined for each spray cycle by the formula (2). In other words, when $I_{feedback}$ is determined for a spray cycle by the formula (2), the microprocessor 241 continuously adjusts the output voltage during the spray cycle so that the current value can be kept at $I_{feedback}$. Then, the temperature and the relative humidity are measured again prior to a succeeding spray cycle, so that $I_{feedback}$ of the formula (2) is adjusted.

Although it is sufficient if the temperature is measured once, the temperature can be measured a plurality of times in a period of one spray cycle and the feedback current can be adjusted every time the temperature is measured. In this way, the feedback current can be adjusted by various methods.

Further, the correction current value I(T, RH) can be arranged to take either one of only two values. For example, the correction value I(T, RH) is set to 0.1 μA in a case where the amount of water in the air is more than a prescribed value, while the correction value I(T, RH) is set to 0 μA in a case where the amount of water in the air is equal to or lower than the prescribed value. In this case, the correction table has a very simple configuration, so that the correction current value I(T, RH) can be figured out rapidly and load for operation processing according to the formula (2) can be further reduced.

[Supplemental Matters]

The power supply device 3 can be adapted to vary the spray period in accordance with the information inputted to the microprocessor 24 from the temperature sensor 251, the humidity sensor 252, and the pressure sensor 253, and the liquid content information 254. The spray period is the sum of the on and off times of the power supply. For example, in a case of a periodical spray period in which the power supply is turned on for a cyclical spray period of 35 seconds (during which time the power supply applies a high voltage between the spray electrode 1 and the reference electrode 2) and is turned off for 145 seconds (during which time the power supply does not apply a high voltage as above), the spray period is 35+145=180 seconds. The spray period can be varied by software built in the microprocessor 241 in the power supply device 3 such that the spray period is increased from a set point as temperature increases and the spray period is decreased from the set point as temperature decreases. Preferably, the spray period is increased or decreased in accordance with a prescribed characteristic determined by properties of the substance to be sprayed. Conveniently, a compensatory variation of the spray period may be limited such that the spray period is only varied between 0 to 60° C. (e.g., 10 to 45° C.), thereby assuming that extreme temperatures registered by the temperature sensor 251 are faults and are discounted whilst still providing an acceptable albeit non-optimized spray period for low and high temperature conditions. Alternatively, the on and off times of the spray period may be adjusted so as to keep the spray period constant, but to increase or decrease the spray time within the spray period as temperature decreases or increases.

The power supply device 3 can further include an inspection circuit for detecting a property of the substance to be sprayed, and generating information indicative of the property of the substance to be sprayed. The information, indicative of the property of the substance to be sprayed, which has been generated by the inspection circuit is supplied to the control circuit 24. The control circuit 24 utilizes the information to compensate at least one voltage control signal. The voltage control signal is a signal generated according to a result obtained by detection of ambient environmental conditions (such as temperature, humidity, and/or atmospheric pressure, and/or spray amount), and a signal for adjusting an output voltage or a spray time. The power supply device 3 may include a pressure sensor 253 for monitoring an ambient pressure (atmospheric pressure).

An internal configuration of the power supply device 3 has been discussed above. However, the above description is only an example of the power supply device 3. The power supply device 3 can be provided so as to have another configuration, provided that the power supply device 3 has the above described functions.

[2. Current Control without Use of Sensor]

In the compensation scheme according to [1. Current Control with Use of Sensor], it is necessary to consider that a leak current randomly occurs on the surface of the dielectric 10 due to water in the air and that the leak current value is different for each electrostatic atomizer. In order to solve the above problem concerning the leak current, the following discusses a configuration in which the feedback current is controlled without use of a sensor.

Figure 4:
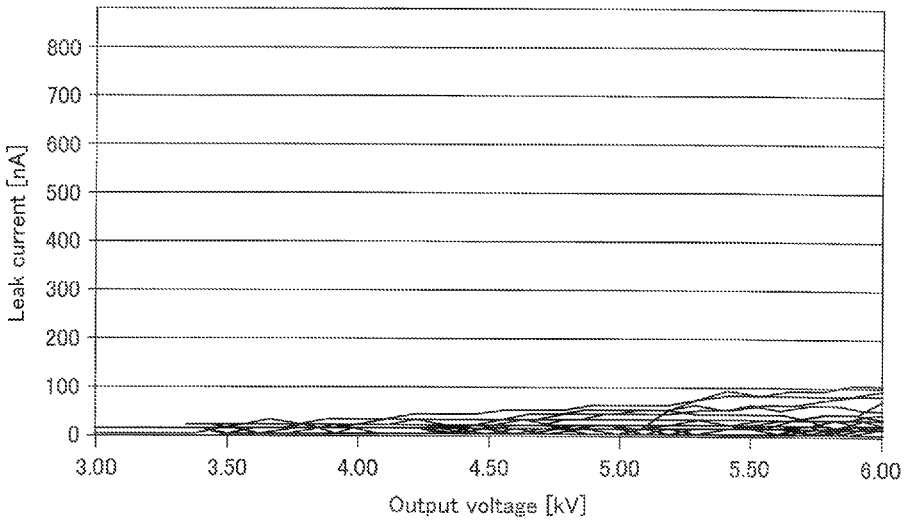
FIG. 4 is a graph showing a relation between a leak current and a voltage applied between a spray electrode and a reference electrode at a temperature of 35 degrees and a relative humidity of 75%.

FIG. 4 is a graph showing a relation between a leak current and a voltage applied between the spray electrode 1 and the reference electrode 2 at a temperature of 35 degrees and a relative humidity of 75%. A horizontal axis of the graph represents an output voltage (kV), while a vertical axis of the graph represents a leak current (nA). Note that FIG. 4 shows a result of measurement in which 30 electrostatic atomizers are used.

In a case where the correction current value (I(T, RH)) in the formula (2) is increased by 0.1 μA under the above conditions, each of the electrostatic atomizers has a stable spray amount. In this case, the leak current is 0.1 μA (=100 nA) at the maximum.

On the other hand, in a case where no leak current occurs under such extreme conditions, the current value at the spray electrode 1 is the sum of the spray current and the corona current. Accordingly, in a case where the correction current value (I(T, RH)) is increased by 0.1 μA, the sum of the spray current and the corona current is increased by 0.1 μA.

In the above case, the inventors of the present application confirmed that that even when the correction current value (I(T, RH)) is increased in a case where no leak current occurs, no large change is observed in the spray amount. This is because an increased current is used in corona discharge, that is, only the corona current increases while the spray current does not increase. Accordingly, even when the correction current value (I(T, RH)) is increased, no large change is observed in the spray current. Therefore, no large change is observed in the spray amount defined by a value of the spray current. This phenomenon occurs because spray stability improves due to the corona discharge. This point is discussed below in more detail.

[Improvement in Spray Stability Due to Corona Discharge]

The electrostatic atomizer 100 can generate a positive charge and a negative charge without use of any special configuration. This is one feature of the electrostatic atomizer 100. In the electrostatic atomizer 100, when a high voltage is applied between the spray electrode 1 and the reference electrode 2, an electric field is formed between the spray electrode 1 and the reference electrode 2. At this time, the spray electrode 1 releases a positively-charged ion species. Meanwhile, the reference electrode 2 emits negatively charged air. This generation of the ion species is also called corona discharge. The electrostatic atomizer 100 can operate at a minute current of, for example, 1 μA or less, and accordingly an avalanche effect due to ions does not occur or is extremely limited.

Figure 5:
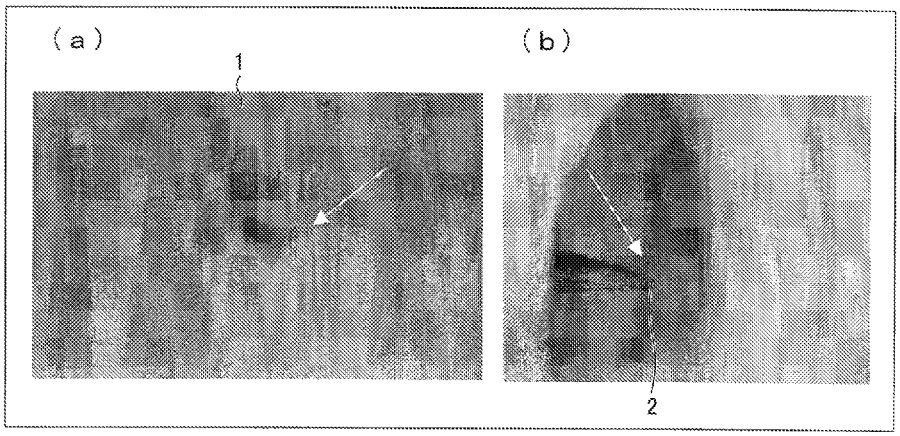
FIG. 5 is a view illustrating states of a spray electrode and a reference electrode in electrostatic atomization; (a) of FIG. 5 illustrates a tip of the spray electrode while (b) of FIG. 5 illustrates a tip of the reference electrode.

FIG. 5 is a view illustrating states of the spray electrode 1 and the reference electrode 2 in electrostatic atomization; (a) of FIG. 5 illustrates the tip of the spray electrode 1 while (b) of FIG. 5 illustrates the tip of the reference electrode 2.

FIG. 5 illustrates that the corona discharge is performed at the tips of the spray electrode 1 and the reference electrode 2 in electrostatic atomization. Formation of a positive corona is not considered preferable because a power consumption increases. However, in a case where the power consumption does not have a critical meaning and a current value of an electrostatic atomizer is such a small value as 1 μA or less, the presence of positive ions or the positive corona has more significant meaning in a spray amount stabilization effect.

Figure 6:
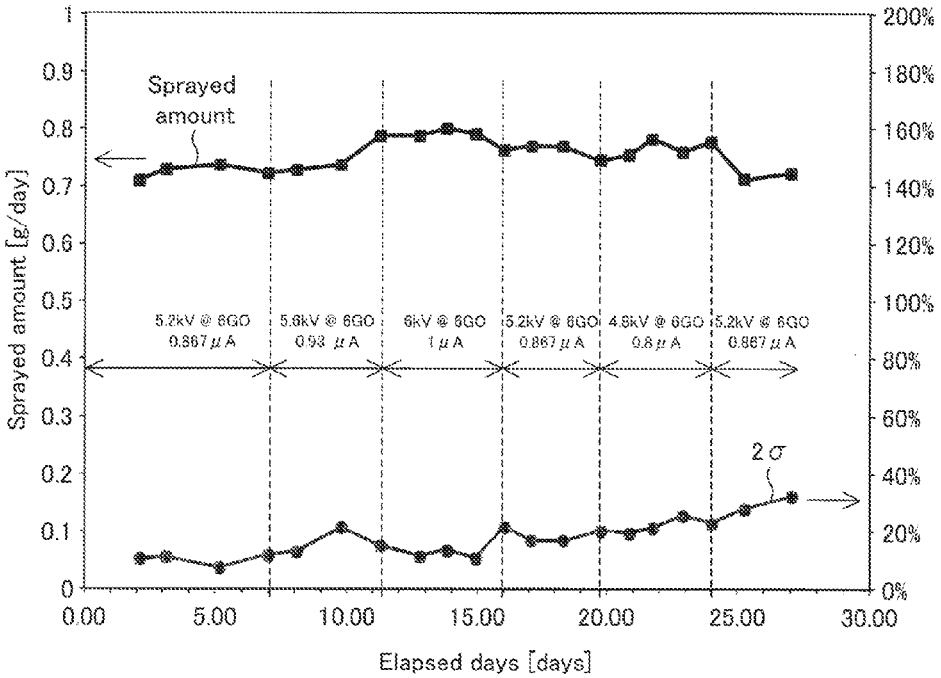
FIG. 6 is a chart showing a sprayed amount in a case where a feedback current was varied and a double standard deviation (2σ) of the sprayed amount.

In order to demonstrate improvement in spray stability due to the corona discharge, a spray test was carried out. In the spray test, the feedback current was varied from 0.8 μA to 1 μA. FIG. 6 shows a result of this spray test. FIG. 6 is a chart showing a sprayed amount in a case where the feedback current was varied and a double standard deviation (2σ) of the sprayed amount. In the chart of FIG. 6, a horizontal axis represents elapsed days (days), a vertical axis on the left represents a spray amount (g/day), and the vertical axis on the right represents 2σ (%).

As shown in FIG. 6, the feedback current is initially set to 0.867 μA. Then, after every 4 or 5 days, the feedback current is changed within a range of 0.8 μA to 1 μA. Further, an output voltage at the time when the feedback current is changed is also recorded. FIG. 6 shows data of an average of 10 electrostatic atomizers. Further, FIG. 6 shows the feedback current, a value of the output voltage, and a value of resistance between the spray electrode 1 and the reference electrode 2.

As shown in FIG. 6, even when the feedback current is varied, the sprayed amount changes little and varies within a range of 0.7 g/d to 0.8 g/d. In a period from $7^{th}$ day to $24^{th}$ day, though the feedback current is varied within a range of 0.8 μA to 1 μA, the sprayed amount is quite stable. This means that the sprayed amount is not influenced by the feedback current. This is a result of a stable voltage between the spray electrode 1 and the reference electrode 2. Such a stable voltage is obtained because the electric field between the spray electrode 1 and the reference electrode 2 is stable and when the feedback current is higher, more of the feedback current is used in corona discharge.

Figure 7:
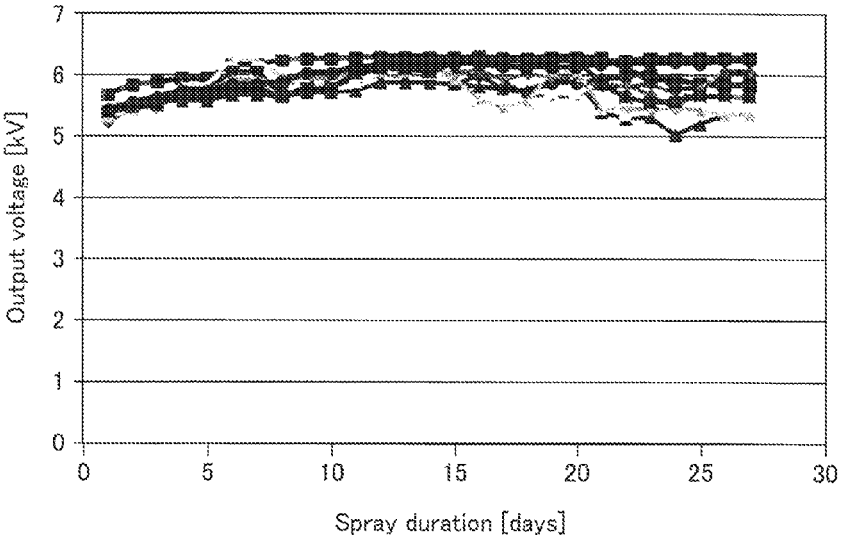
FIG. 7 is a graph showing an output voltage in an experimental test shown in FIG. 6.

Further, FIG. 7 shows an additional effect found in the spray test. FIG. 7 is a graph showing the output voltage in the spray test shown in FIG. 6. In FIG. 7, a horizontal axis represents a spray duration (days) while a vertical axis represents the output voltage (kV). As illustrated in FIG. 7, during the spray duration, the output voltage varies little and has a low correlation with the feedback current.

Figure 8:
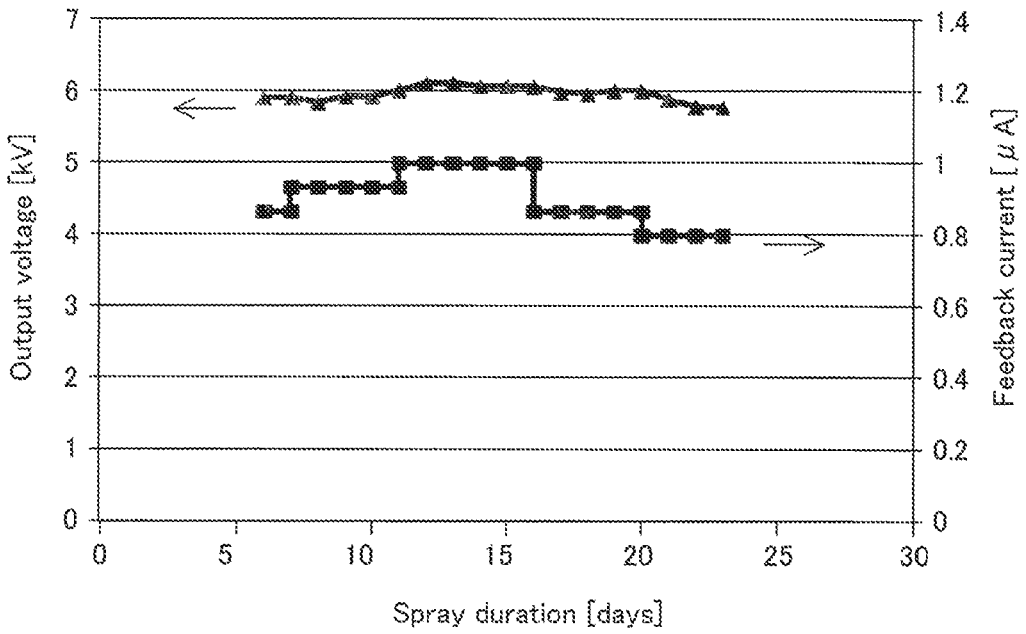
FIG. 8 is a graph illustrating a feedback current and the output voltage in the experimental test ($7^{th}$ day to $24^{th}$ day) shown in FIG. 6.

Such little variation in output voltage and such a low correlation is discussed more in detail below with reference to FIG. 8. FIG. 8 is a view illustrating the output voltage and the feedback current in the experimental test ($7^{th}$ day to $24^{th}$ day) shown in FIG. 6. In FIG. 8, a horizontal axis represents the spray duration (days), a vertical axis on the left represents the output voltage (kV), and the vertical axis on the right represents the feedback current (μA).

As illustrated in FIG. 8, the feedback current varies within the range of 0.8 μA to 1 μA and a range of such variation of the feedback current is 11%. Meanwhile, the output voltage varies around 6 kV and a range of variation of the output voltage stays within 3%. This fact indicates that much of increased current is consumed in corona discharge. In other words, when the feedback current increases, a corona current increases in accordance with an increase of the feedback current. However, the spray current does not change largely. Therefore, the spray current is stable, accordingly realizing stable spray in which a change in spray amount is small.

The above results show that the corona discharge reduces a variation or an error of a set value of the feedback current and advantageously provides an effect of maintaining stable spray.

In view of the above, even the current control without use of a sensor is effective in providing stable spray, if a value of the feedback current is set within a range in which the spray current is not influenced.

[Effects of Current Feedback Control]

The above has discussed the current feedback control with use of a sensor and the current control without use of a sensor. The following discusses effects of each of these control methods.

[1. Effects of Current Control with Use of Sensor]

The compensation scheme according to the current control with use of a sensor requires the temperature sensor 251 and the humidity sensor 252. However, this compensation scheme increases the feedback current only in a case where the leak current due to humidity is likely to occur. This makes it possible to reduce a power consumption. Further, even in a case where a level of the leak current differs in each device, it is possible to maintain a stable spray amount through a spray current stabilization effect provided by the corona discharge. This point is discussed below with reference to FIGS. 9 through 11.

Figure 9:
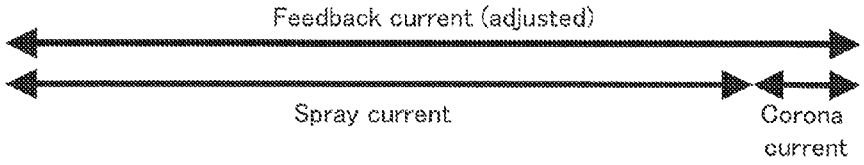
FIG. 9 is a diagram illustrating current proportions under a low-humidity condition.
Figure 10:
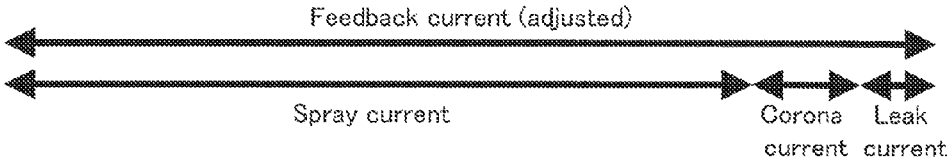
FIG. 10 is a diagram illustrating current proportions in a case where a leak current occurs under a high-humidity condition.
Figure 11:
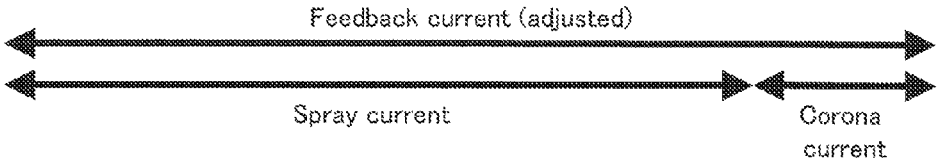
FIG. 11 is a diagram illustrating current proportions in a case where no leak current occurs under a high-humidity condition.

FIG. 9 illustrates current proportions under a low-humidity condition. FIG. 10 illustrates current proportions in a case where a leak current occurs under a high-humidity condition. FIG. 11 illustrates current proportions in a case where no leak current occurs under a high-humidity condition.

In the case under the low-humidity condition as illustrated in FIG. 9, the feedback current is the sum of the spray current and the corona current. On the other hand, in the case under the high-humidity condition as illustrated in FIG. 10, I(T, RH) in the formula (2) is added to the feedback current in a case where the leak current is likely to occur. In other words, the feedback current $I_{feedback}$ is the sum of $I_{initial}$ and I(T, RH). In a case where no leak current occurs in the above case, I(T, RH) is used as the corona current and the spray current does not change as illustrated in FIG. 11.

As illustrated in FIGS. 9 through 11, the spray current is kept substantially at a constant value regardless of high and low humidity conditions and the presence of the leak current, through the compensation scheme according to the current control with use of a sensor, as described above. As a result, the electrostatic atomizer 100 can stabilize the spray amount.

[2. Effects of Current Control without Use of Sensor]

The compensation scheme according to the current control without use of a sensor requires neither the temperature sensor 251 nor the humidity sensor 252. This makes it possible to reduce design cost and production cost of the electrostatic atomizer. On the other hand, the current control without use of a sensor consumes more power than the current control with use of a sensor, because the feedback current is set to a higher value in the current control without use of a sensor. However, in a case where the feedback current is such a low current as 1 μA or less and accordingly, a power consumption does not have a critical meaning, discussion of a level of the power consumption does not have much significance. The following discusses effects of the current control without use of a sensor, with reference to FIGS. 12 to 14.

Figure 12:
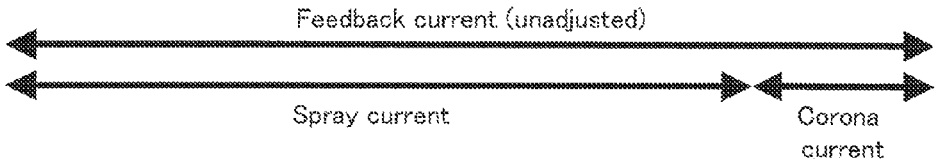
FIG. 12 is a diagram illustrating current proportions under a low-humidity condition.
Figure 13:
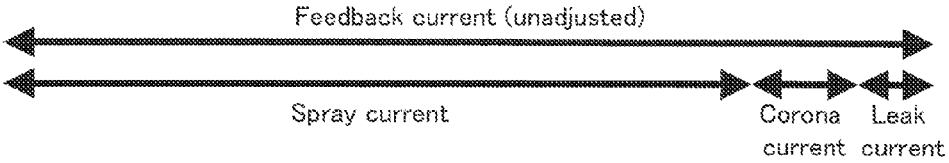
FIG. 13 is a diagram illustrating current proportions in a case where a leak current occurs under a high-humidity condition.
Figure 14:
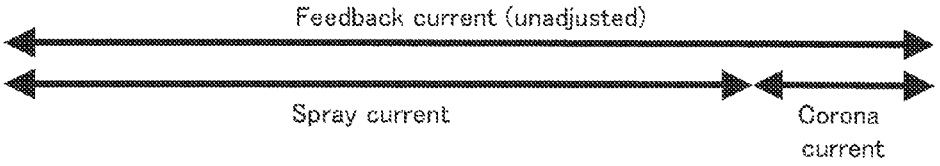
FIG. 14 is a diagram illustrating current proportions in a case where no leak current occurs under a high-humidity condition.

FIG. 12 illustrates current proportions under a low-humidity condition. FIG. 13 illustrates current proportions in a case where a leak current occurs under a high-humidity condition. FIG. 14 illustrates current proportions in a case where no leak current occurs under a high-humidity condition. FIGS. 12 through 14 are different from FIGS. 9 through 11 above in a point that the feedback current is set to a relatively higher value without measurement of a temperature and a humidity.

The term "relatively higher value" of the feedback current here is preferably a value within a range of more than 1.0 time and 1.2 or less times as large as the spray current. This preferable range is found by the inventors of the present invention based on experiments carried out by the inventors and experiences of the inventors. In a case where the feedback current is higher than 1.0 time as large as the spray current, the influence of the leak current on the spray current can be prevented even in a case where the leak current occurs between the spray electrode 1 and the reference electrode 2. This is because a difference between the feedback current and the spray current is used as the leak current. Meanwhile, in a case where the feedback current is 1.2 or less times as large as the spray current, it is possible to reduce a power consumption and also to prevent the spray electrode 1 and the reference electrode 2 from being worn away due to application of a high voltage.

In the case under the low-humidity condition as illustrated in FIG. 12, the feedback current is the sum of the spray current and the corona current. In the case under the high-humidity condition as illustrated in FIG. 13, a current obtained by subtracting the spray current and the leak current from the feedback current is used as the corona current in a case where the leak current occurs. In other words, in comparison of the current proportions in FIGS. 12 and 13, the spray current itself does not change because the leak current which has occurred is subtracted from the corona current. Further, in FIG. 14, a current to be used as the corona current increases as compared to that in FIG. 13, because no leak current occurs. In this case, the spray current does not change from that in FIG. 13.

As illustrated in FIGS. 12 through 14, the spray current is kept substantially at a constant value regardless of high and low humidity conditions and the presence of the leak current, as described above.

In this way, in the electrostatic atomizer of the present embodiment, both the current control with use of a sensor and the current control without use of a sensor are applicable. The electrostatic atomizer can be suitably applied to both a case where the current control with use of a sensor is applied and a case where the current control without use of a sensor is applied.

Figure 15:
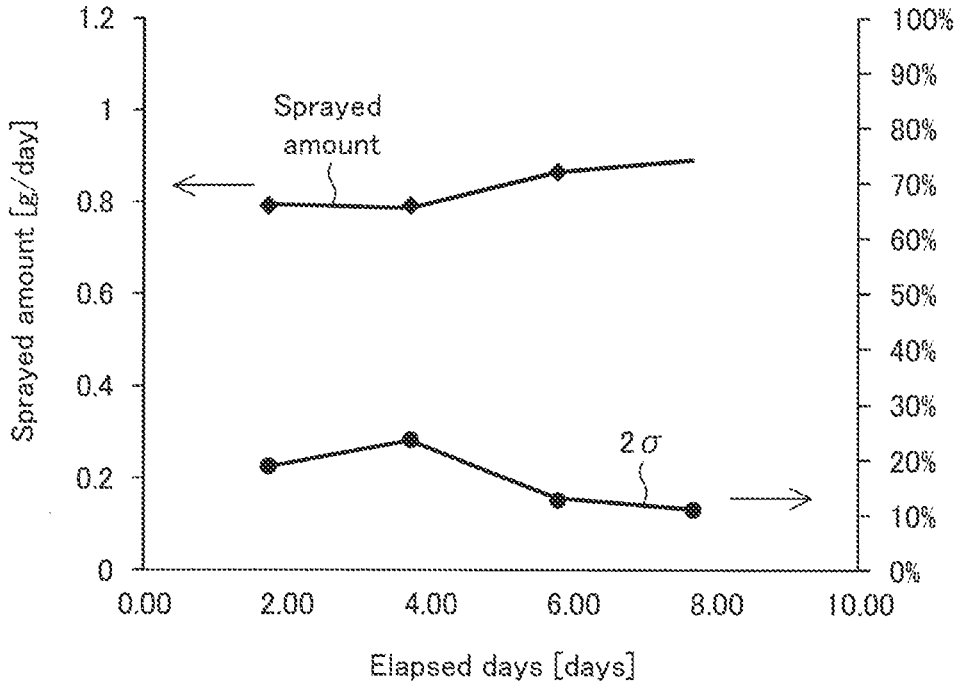
FIG. 15 is a graph showing a result of spraying in a case where a feedback current was set to 1 μA under a high-humidity condition.

Next, the following discusses a result of a test which is intended to confirm spray stability under a high-humidity condition. FIG. 15 is a graph showing a result of spraying in a case where the feedback current was set to 1 μA under a high-humidity condition. The test was carried out under conditions of a temperature of 35 degrees, a relative humidity of 75%, and a feedback current of 1 μA. In FIG. 15, a horizontal axis represents elapsed days (days), a vertical axis on the left represents a spray amount (g/day), and the vertical axis on the right represents 2σ (%).

Theoretically, the feedback current can be set to any value. However, in consideration of a current consumption and suppression of influence of the feedback current on device performance to the minimum, an increase rate of a feedback current value is desirably within a range less than 20% of the feedback current value. Further, in consideration of a humidity condition, an increased amount of the current is desirably arranged to be 0.1 μA.

FIG. 15 shows a result of spraying in a case where the feedback current is set to 1 μA (an increased current of approximately 0.1 μA) at the temperature of 35 degrees and the relative humidity of 75%. In comparison with a result of spraying for 11 days to 16 days (elapsed days) as shown in FIG. 6 where the feedback current is set to 1 μA, the spray amount less varies and the device performance is more stable in the result shown in FIG. 15. In addition, in FIG. 15, the influence of the leak current is suppressed to the minimum.

The following discusses a reason why the feedback current was set to 1 μA in the spray test illustrated in FIG. 15. Under the conditions at the temperature of 35° C. and the relative humidity of 75%, the maximum value of the leak current measured in the spray test is 0.1 μA. Accordingly, this 0.1 μA for the leak current is added to the initially set current value $I_{initial}$ of 0.87 μA and accordingly, 0.97 μA is obtained. To this current value of 0.97 μA, a margin is added. Thus obtained current value of 1 μA is set as the feedback current. According to the result of the test, the influence of the leak current is suppressed to the minimum when the feedback current is set to 1 μA.

As described above, a current control method of the present embodiment can provide an electrostatic atomizer excellent in spray stability even under a high-humidity condition.

[Supplemental Matters]

The present invention can also be configured as follows.

In an electrostatic atomizer according to one aspect of the present invention, the second current value is more than 1.0 time and 1.2 or less times as large as the first current value.

In a case where the second current value is higher than 1.0 time as large as the first current value, the influence of the leak current on the spray current can be prevented even in a case where the leak current occurs between the first electrode and the second electrode. This is because a difference (or part of a difference) between the second current value and the first current value is used as the leak current.

Meanwhile, in a case where the second current value is 1.2 or less times as large as the first current value, it is possible to reduce a power consumption as well as preventing the first electrode and the second electrode from being worn away due to application of a high voltage.

In an electrostatic atomizer according to one aspect of the present invention, the current control section can be configured to determine the second current value on the basis of an amount of water in the air.

In a case where a droplet attaches to a device surface between the first electrode and the second electrode of the electrostatic atomizer, the droplet may cause a leak current between the first electrode and the second electrode. A possible cause of such attachment of the droplet to the device surface is water in the air under a high-humidity condition.

On this account, the current control section having the above configuration should set the second current value to a high value in a case where the amount of water in the air is large. Meanwhile, in a case where the amount of water in the air is small, the current control section should set the second current value to a low value. This allows the electrostatic atomizer according to one aspect of the present invention to suppress the power consumption to a lower level as compared to a case where the second current value is always controlled to be a high value.

In an electrostatic atomizer according to one aspect of the present invention, the current control section can be configured to figure out a correction value corresponding to the amount of water in the air with reference to a correction table in which the amount of water in the air is associated with the correction value which is to be used for determination of the second current value, and determine the second current value by a formula (1):

$$I_{feedback}=I_{initial}+I_W \qquad \text{Formula (1)}$$

$I_{feedback}$: the second current value $I_{initial}$: the first current value $I_W$: the correction value corresponding to the amount of water in the air.

In the electrostatic atomizer according to one aspect of the present invention, the correction table is prepared in advance, so that the correction value for determination of the second current value can be rapidly figured out. Further, the electrostatic atomizer also can reduce load for operation processing because the second current value is determined by the formula (1).

Preferably, the correction value is varied in accordance with various specifications (shapes, materials, etc.) of the first electrode and the second electrode, various layouts of the first electrode, etc. in the electrostatic atomizer, and the like. In the electrostatic atomizer according to one aspect of the present invention having the above configuration, an optimum correction value can be rapidly figured out and further, load for operation processing can be reduced because the second current value is determined by the formula (1).

In an electrostatic atomizer according to one aspect of the present invention, in a case where the amount of water in the air is more than a prescribed value, the correction value is a value of a leak current which occurs on an electrostatic atomizer surface between the first electrode and the second electrode.

In the above configuration, in a case where the correction value is a leak current value, no spray current is used as the leak current. This makes it possible to maintain stable spray and also makes it possible to prevent an increase in power consumption because the second current value is not determined to be an excessively large value Note that in a case where the amount of water in the air is lower than a prescribed value, the leak current is unlikely to occur. Therefore, the above configuration should be applied in a case where the amount of water in the air is more than the prescribed value.

In addition, the leak current can be measured in advance in association with each of various amounts of water in the air, and contained as a correction value in the correction table. Furthermore, the "prescribed value" of the amount of water in the air is not limited to a specific value but can be changed as appropriate.

An electrostatic atomizer according to one aspect of the present invention can be configured to further include: a temperature detecting section for detecting an ambient temperature; and a humidity detecting section for detecting a relative humidity of the air, wherein the amount of water in the air is derived from the ambient temperature detected by the temperature detecting section and the relative humidity of the air detected by the humidity detecting section.

The electrostatic atomizer according to one aspect of the present invention can derive the amount of water in the air, being provided with the temperature detecting section and the humidity detecting section.

Therefore, the electrostatic atomizer according to one aspect of the present invention can determine the second current value on the basis of the amount of water in the air.

The present invention is not limited to the embodiments, but can be altered by a skilled person in the art within the scope of the claims. An embodiment derived from a proper combination of technical means each disclosed in a different embodiment is also encompassed in the technical scope of the present invention.

INDUSTRIAL APPLICABILITY

The present invention can be suitably applied to an electrostatic atomizer that sprays aromatic oil, a chemical substance for an agricultural product, a medicine, an agricultural chemical, a pesticide, an air cleaning agent, or the like.

REFERENCE SIGNS LIST

1 spray electrode (first electrode)
2 reference electrode (second electrode)
3 power supply device
5 tip
6 spray electrode mounting section
7 reference electrode mounting section
9 inclined plane
10 dielectric
11, 12 opening
21 power source
22 high voltage generator (voltage applying section)
23 monitoring circuit
24 control circuit (current control section)
25 feedback information
100 electrostatic atomizer
221 oscillator
222 transformer
223 converter circuit
231 current feedback circuit
232 voltage feedback circuit
241 microprocessor
251 temperature sensor (temperature detecting section)
252 humidity sensor (humidity detecting section)
253 pressure sensor
254 liquid content information
255 sprayhead-type interrogator circuit

The invention claimed is:

1. An electrostatic atomizer comprising:

a first electrode which sprays a substance from a tip;

a second electrode being one of two electrodes between which a voltage is applied, the first electrode being another one of the two electrodes;

a current control section for controlling a value of a current at the second electrode; and a voltage applying section for applying the voltage between the first electrode and the second electrode, in accordance with the value of the current controlled by the current control section, the current control section controlling the value of the current at the second electrode so that the value of the current is set to a second current value which is higher than a first current value corresponding to a prescribed spray amount of the substance, wherein the second current value is more than 1.0 time and 1.2 or less times as large as the first current value, the current control section determines the second current value on the basis of an amount of water in the air, and the current control section figures out a correction value corresponding to the amount of water in the air with reference to a correction table in which the amount of water in the air is associated with the correction value which is to be used for determination of the second current value, and determines the second current value by a formula (1):

$$I_{feedback}+I_{initial}+I_W \qquad \text{Formula (1)}$$

$I_{feedback}$: the second current value $I_{initial}$: the first current value $I_W$: the correction value corresponding to the amount of water in the air.

2. The electrostatic atomizer as set forth in claim 1, wherein:

in a case where the amount of water in the air is more than a prescribed value, the correction value is a value of a leak current which occurs on an electrostatic atomizer surface between the first electrode and the second electrode.

3. The electrostatic atomizer as set forth in claim 1, further comprising:

a temperature detecting section for detecting an ambient temperature; and a humidity detecting section for detecting a relative humidity of the air, wherein the amount of water in the air is derived from the ambient temperature detected by the temperature detecting section and the relative humidity of the air detected by the humidity detecting section.

* * * * *